US005647454A

United States Patent [19]

Fehr

[11] Patent Number: 5,647,454

[45] Date of Patent: Jul. 15, 1997

[54] FAST TRACT TREE CLIMBLING APPARATUS

[76] Inventor: Daniel D. Fehr, Rte. 1, Box 1100, Cross Hill, S.C. 29332

[21] Appl. No.: 492,208

[22] Filed: Jun. 19, 1995

[51] Int. Cl.[6] ..... A63B 27/00

[52] U.S. Cl. ..... 182/133; 182/187

[58] Field of Search ..... 182/133, 134, 182/135, 136, 187

[56] References Cited

U.S. PATENT DOCUMENTS

| | | | |
|---|---|---|---|
| 742,447 | 10/1903 | Kidder | 182/133 |
| 1,299,289 | 4/1919 | Berg | 182/133 |
| 2,654,638 | 10/1953 | Elliott | 182/133 |
| 3,520,383 | 7/1970 | Lööck | 182/133 |
| 3,727,723 | 4/1973 | Pitcairn et al. | 182/133 |
| 4,008,785 | 2/1977 | Mugnaini | 182/133 |
| 4,150,733 | 4/1979 | Plummer | 182/187 |
| 5,086,874 | 2/1992 | Treants | 182/136 |

*Primary Examiner*—Alvin C. Chin-Shue

[57] ABSTRACT

A new and improved portable tree climbing apparatus for a hunter for ascending and descending a tree is disclosed. The invention comprises an upper member having a seat adapted for swivelly supporting a hunter and an arcuate retaining loop adapted for rolling communication with the tree and keeping the upper member in a horizontal disposition when ascending and descending the tree. The retaining loop has a first end and a second end adapted for releasable engagement with the seat. A lower member has a safety blade disposed in releasable ratchetable engagement with a trunk of the tree for keeping the apparatus in stable communication with the trunk when ascending the tree. A traction wheel is disposed therebetween on an upstanding elongated member and has a plurality of teeth in intermittent contact with the trunk for effortlessly ascending and descending the tree. Finally, a plurality of cross braces are obliquely disposed and in support communication with the lower member and the upper member for maintaining the relative distance between the two members.

2 Claims, 4 Drawing Sheets

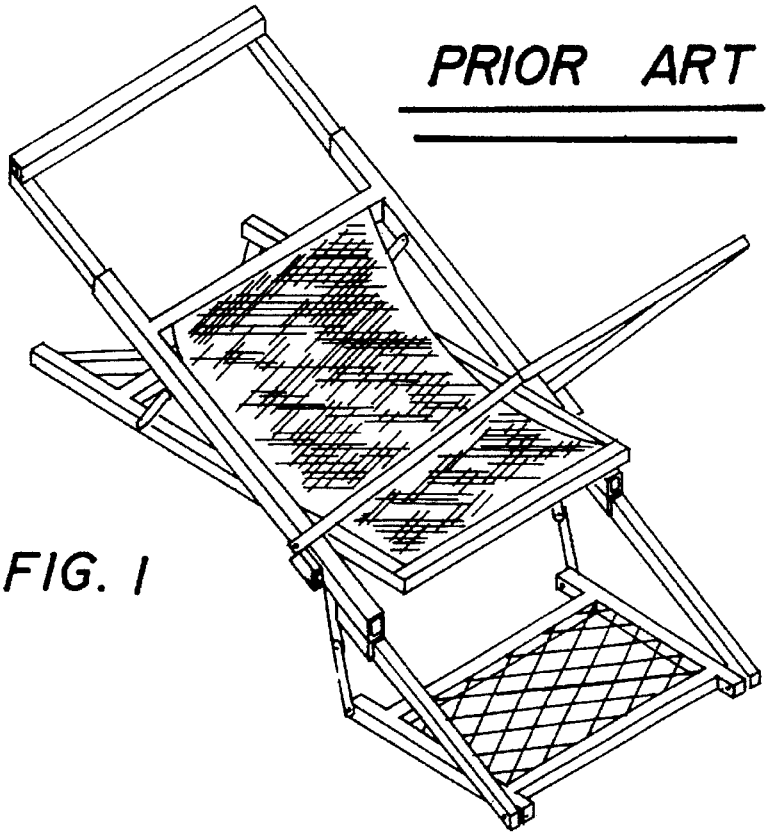
FIG. 1
FIG. 2
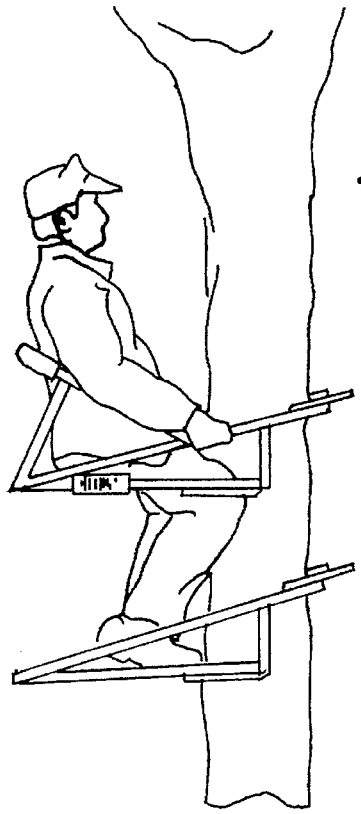

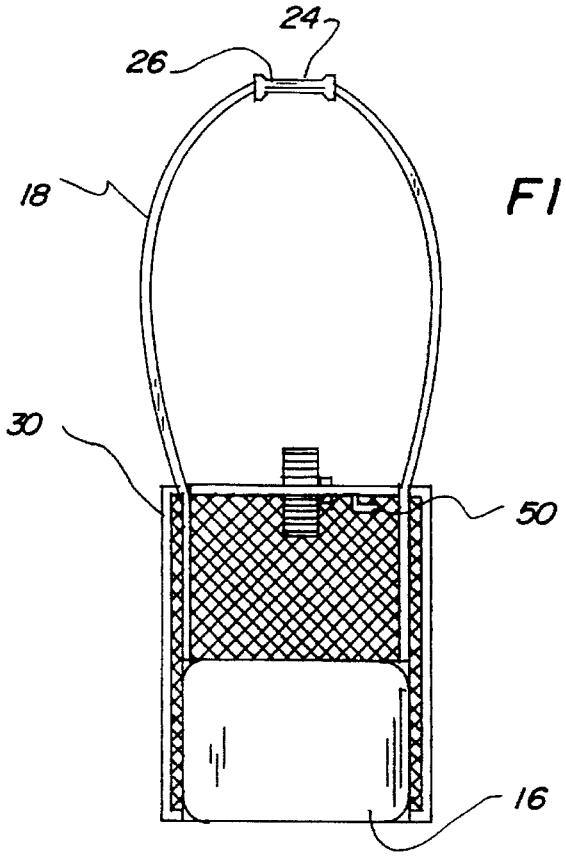
FIG. 5
FIG. 6
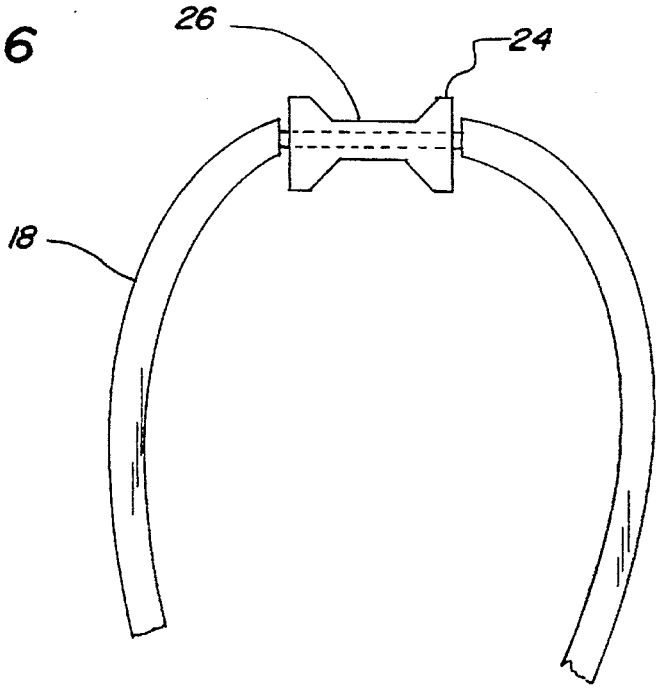

FAST TRACT TREE CLIMBLING APPARATUS

BACKGROUND OF THE INVENTION

1. Field of the Invention

The present invention relates to a new and improved fast track tree climbing apparatus and, more particularly, pertains to a tree climbing apparatus for hunters for advancing up and down a tree effortlessly and quietly and safely.

2. Description of the Prior Art

The use of other devices and apparatus to elevate a hunter to a greater height having many parts and being difficult to deploy and operate in the field is known in the prior art. More specifically, other devices and apparatus to elevate a hunter to a greater height having many parts and being difficult to deploy and operate in the field heretofore devised and utilized for the purpose of tree climbing stands that advance up a tree with great physical effort and difficulty, are noisy, have no provision for the safety of the hunter, and are known to consist basically of familiar, expected, and obvious structural configurations, notwithstanding the myriad of designs encompassed by the crowded prior art which has been developed for the fulfillment of countless objectives and requirements.

The prior art discloses a large number of other devices and apparatus to elevate a hunter to a greater height having many parts and being difficult to deploy and operate in the field. By way of example, U.S. Pat. No. 4,331,216 issued to Amaker discloses a tree climbing apparatus having a first upright member with a gripping structure, a movable platform spaced from the upright member to house a hunter, and gun rack storage means.

U.S. Pat. No. 4,969,538 issued to Amaker discloses a tree climbing stand having two climbing elements and a spring actuated mechanism for locking the tree stand in an operational position.

U.S. Pat. No. 5,156,236 issued to Gardner et al. appears to disclose an apparatus for climbing a tree having two frames, an upper frame and a lower frame for alternately raising up a tree or lowering down a tree.

U.S. Pat. No. 5,090,505 issued to Amaker discloses a tree climbing stand having two climbing elements and a spring actuated element for locking the tree in an expanded operational position.

U.S. Pat. No. 5,143,176 issued to Burdette discloses a climbing apparatus having a mechanical means of ascending and descending a tree and support means for a person when in a locked operational position.

In this respect, the fast track tree climbing apparatus according to the present invention substantially departs from the conventional concepts and designs of the prior art, and in doing so provides an apparatus primarily developed for the purpose of a tree climbing apparatus for hunters for advancing up and down a tree effortlessly and quietly and safely.

It is therefore an object of the present invention to provide a new and improved fast track tree climbing apparatus which has all the advantages of the prior art devices and apparatus to elevate a hunter to a greater height with none of the disadvantages.

It is another object of the present invention to provide a new and improved fast track tree climbing apparatus which may be easily and efficiently manufactured and marketed.

It is a further object of the present invention to provide a new and improved fast track tree climbing apparatus which is of a durable and reliable construction.

An even further object of the present invention is to provide a new and improved fast track tree climbing apparatus which is susceptible of a low cost of manufacture with regard to both materials and labor, and which accordingly is then susceptible of low prices of sale to the consuming public, thereby making such a fast track tree climbing apparatus economically available to the buying public.

Still yet another object of the present invention is to provide a new and improved fast track tree climbing apparatus which provides in the apparatuses and methods of the prior art some of the advantages thereof, while simultaneously overcoming some of the disadvantages normally associated therewith.

Even still another object of the present invention is to provide a tree climbing apparatus for hunters for advancing up and down a tree effortlessly and quietly and safely.

Lastly, it is an object of the present invention to provide a new and improved portable tree climbing apparatus for a hunter for ascending and descending a tree. The invention comprises an upper member having a seat adapted for swivelly supporting a hunter and an arcuate retaining loop adapted for rolling communication with the tree and keeping the upper member in a horizontal disposition when ascending and descending the tree. The retaining loop has a first end and a second end adapted for releasable engagement with the seat. A lower member has a safety blade disposed in releasable ratchetable engagement with a trunk of the tree for keeping the apparatus in stable communication with the trunk when ascending the tree. A traction wheel is disposed therebetween on an upstanding elongated member and has a plurality of teeth in intermittent contact with the trunk for effortlessly ascending and descending the tree. Finally, a plurality of cross braces are obliquely disposed and in support communication with the lower member and the upper member for maintaining the relative distance between the two members.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Therefore, it can be appreciated that there exists a continuing need for a new and improved fast track tree climbing apparatus which can be used for a tree climbing apparatus for hunters for advancing up and down a tree effortlessly and quietly and safely. In this regard, the present invention substantially fulfills this need.

SUMMARY OF THE INVENTION

In view of the foregoing disadvantages inherent in the known types of other devices and apparatus to elevate a hunter to a greater height having many parts and being difficult to deploy and operate in the field now present in the prior art, the present invention provides a new and improved fast track tree climbing apparatus. As such, the general purpose of the present invention, which will be described subsequently in greater detail, is to provide a new and improved fast track tree climbing apparatus and methods which have all the advantages of the prior art and none of the disadvantages.

To attain this, the present invention essentially comprises a portable tree climbing apparatus for a hunter for ascending and descending a tree. The invention has an upper member with a seat adapted for swivelly supporting a hunter and an arcuate retaining loop adapted for rolling communication with the tree and keeping the upper member in a horizontal disposition when ascending and descending the tree. The retaining loop has a first end and a second end adapted for releasable engagement with the seat and further includes a cylinder disposed in a middle section of the retaining loop for rotatable communication when ascending or descending the tree. Further, the seat has swiveling means to allow the hunter to face the tree or face away from the tree when the apparatus has reached the desired elevation.

A lower member has a safety blade disposed in releasable ratchetable engagement with a trunk of the tree and keeps the apparatus in stable communication with the trunk when ascending the tree. The lower member also has a plurality of retaining rods horizontally disposed for disengaging the safety blade from the trunk and urging swift safe descent down the tree. The plurality of retaining rods have an upper rod in torsion communication with an upper portion of the safety blade and a lower rod in releasable engagement with a lower portion of the safety blade. The rods maintain the disengaged status of the safety blade when the hunter descends the tree.

A traction wheel is disposed therebetween and has a plurality of teeth disposed on an upstanding elongated member. The teeth are in intermittent contact with the trunk for effortlessly ascending and descending the tree. The wheel has a crank handle and a reduction gear box in tooth communication with the tractor wheel which reduces the effort required to ascend the tree. A plurality of cross braces are obliquely disposed in support communication with the lower member and the upper member. The braces maintain the relative distance between the two members.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a prior art tree stand;

FIG. 2 is a conceptual schematic of the prior art disclosure in use and operation by a hunter;

FIG. 5 is a top plan sectional view of the invention taken along viewing lines 5—5 in FIG. 3 disclosing the upper member having a seat cushion and a retaining loop with a cylindrical roller, and the traction wheel disposed therebeneath;

FIG. 6 is a rear elevational sectional view of the retaining loop and roller taken along viewing lines 6—6 in FIG. 3;

FIG. 7 discloses the safety blade and the plurality of horizontally disposed rods;

The same reference numerals refer to the same parts throughout the various Figures.

DESCRIPTION OF THE PREFERRED EMBODIMENT

Figure 3:
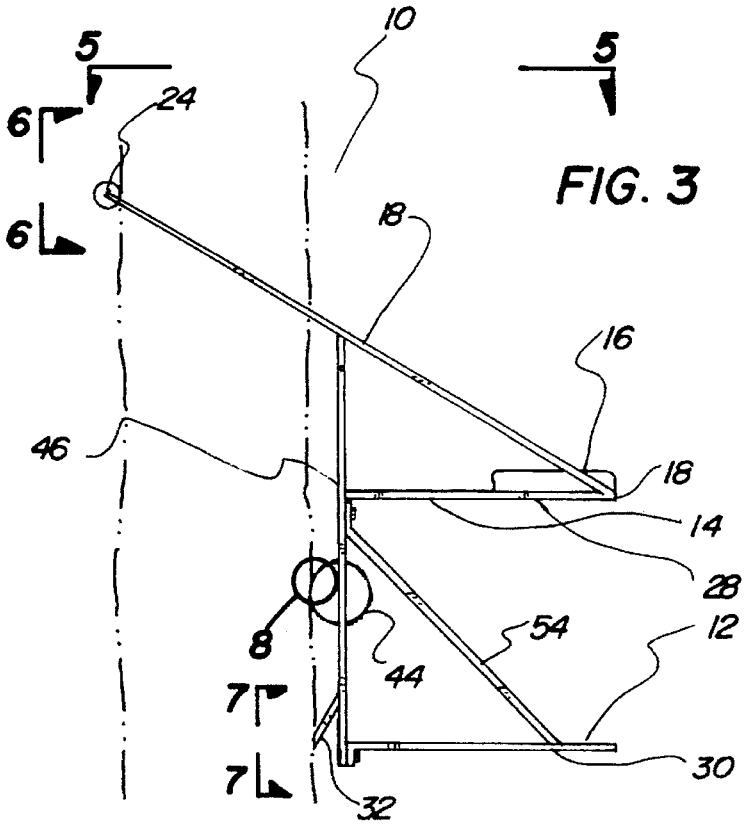
FIG. 3 is a left side elevation view of the instant invention in toothed contact with the trunk of a tree.
Figure 4:
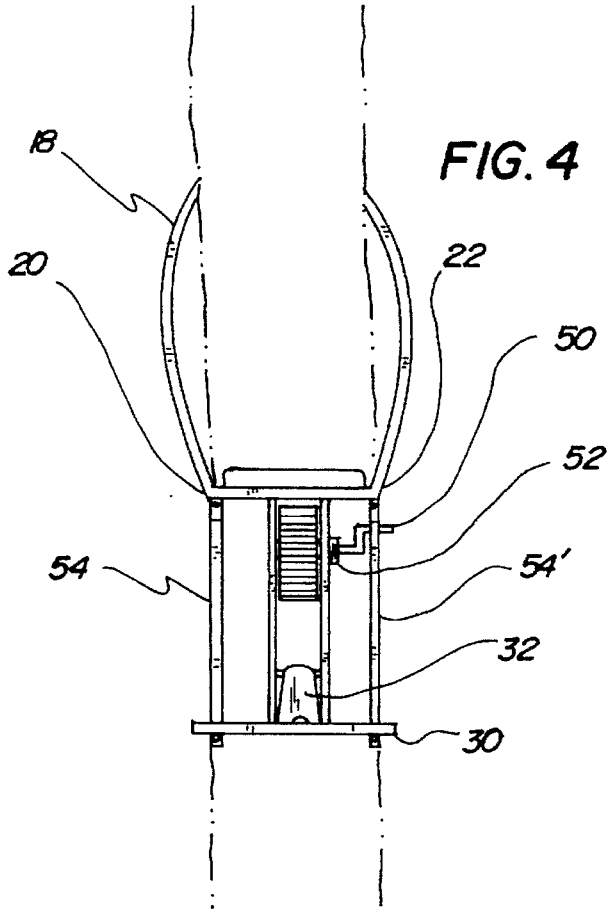
FIG. 4 is a front elevation view of the invention engaged with a tree trunk as disclosed in FIG. 3.
Figure 7:
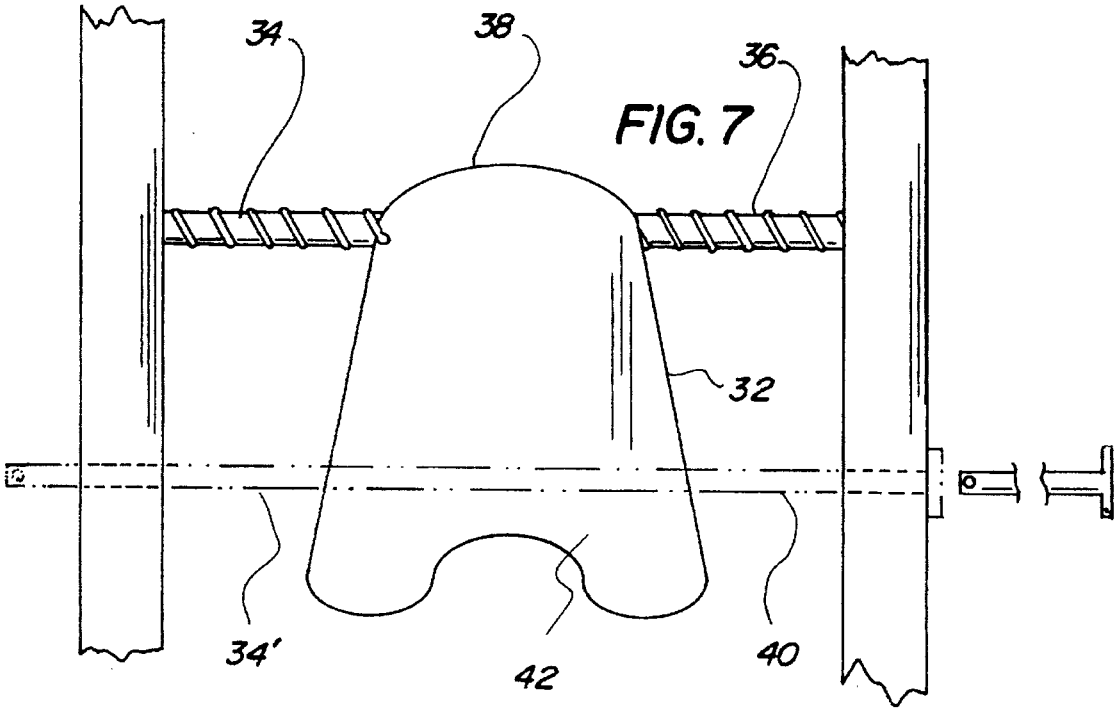
FIG. 7 is a rear elevational sectional view taken along viewing lines 7—7 in FIG. 3.
Figure 8:
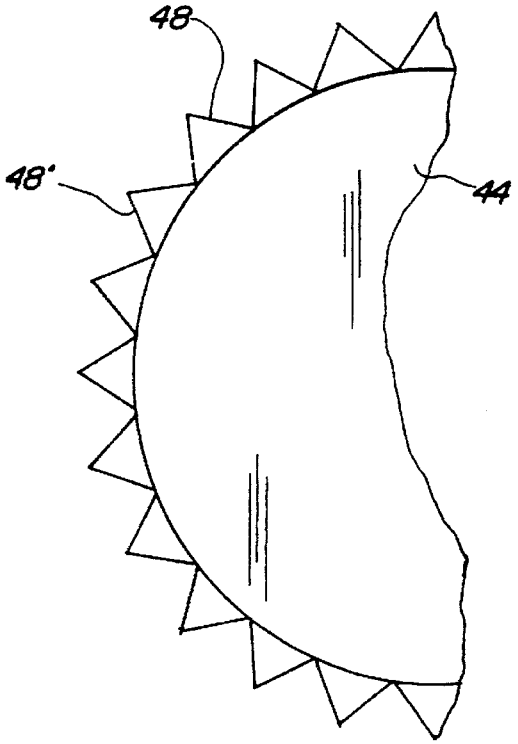
FIG. 8 is a fragmentary sectional view of the traction wheel as indicated in sectional circle 8 in FIG. 3 disclosing the toothed traction wheel.

With reference now to the drawings, and in particular to FIGS. 1 through 8 thereof, the preferred embodiment of the new and improved fast track tree climbing apparatus embodying the principles and concepts of the present invention and generally designated by the reference numeral 10 will be described.

The present invention, the new and improved fast track tree climbing apparatus is a system comprised of a plurality of components. The components in their broadest context include an upper member, a lower member and a traction wheel. Each of the individual components is specifically configured and correlated one with respect to the other to attain the desired objectives. The device can be used to assist the hunter in ascending a tree and also for serving as a perch for the hunter once elevated. The tree stand has a crank on it with a gear reduction box to make it easier to ascend up the tree. The crank is made so the hunter can advance up a tree faster with no noise whatsoever. The gear reduction parts and crank shift rollers are maintenance free and do not require any kind of lubrication.

Referring generally to FIG. 3, the invention 10 comprises a portable tree climbing apparatus 12 for a hunter for ascending and descending a tree. An upper member 14 has a seat 16 adapted for swivelly supporting the hunter. An arcuate retaining loop 18 provides rolling communication with the tree and keeps the upper member 14 in a horizontal disposition when ascending and descending the tree. The retaining loop 18 has a first end 20 and a second end 22 adapted for releasable engagement with the seat 16. The loop 18 also has a cylinder 24 disposed in a middle section 26 for rotatable rolling communication when ascending or descending the tree. The seat 16 is adapted with swiveling means 28 to allow the hunter to face the tree or face away from the tree when the apparatus 12 has reached the desired elevation.

A lower member 30 has a safety blade 32 that is disposed engageable with a trunk of the tree. The safety blade 32 keeps the apparatus 12 in stable communication with the trunk when ascending the tree. The lower member 30 is adapted with a plurality of retaining rods 34,34' that are horizontally disposed for disengaging the safety blade 32 from the trunk. When disengaged, the safety blade 32 urges swift safe descent down the tree. The plurality of retaining rods 34,34' also include an upper rod 36 in pivotally coupled with an upper portion 38 of the safety blade 32 and a lower rod 40 in releasable engagement with a lower portion 42 of the safety blade 32. The lower rod 40 maintains the safety blade 32 in a disengaged status when the hunter descends the tree. The safety blade 42 is pivoted rearwardly to allow the lower rod 40 to be positioned behind the lower portion 42 of the safety blade 32 thereby allowing for the disengagement of the safety blade 32 from the tree trunk.

A traction wheel 44 is disposed therebetween on an upstanding elongated member 46. The wheel 44 is adapted with a plurality of teeth 48,48' which are in intermittent contact with the trunk for effortlessly ascending and descending the tree. The traction wheel 44 is adapted with a crank handle 50 and a reduction gear box 52 in toothed communication with the traction wheel 44. The crank handle 50 and gear box 52 reduce the effort required to ascend the tree. A plurality of cross braces 54,54' are obliquely disposed and in support communication with the lower member 30 and the upper member 14. The cross braces 54,54' maintain the relative distance between the two members 14,30.

The teeth 48,48' on the traction wheel 44 can be fabricated with rubber teeth or geared serrations, preferably rubber teeth. The wheel 44 is mounted below the seat 16. The crank handle 50 is located on the other side of the seat 16. The lower member 30 is basically a platform which is suspended from the upper member 14 with the plurality of crossbraces 54,54'.

In use and operation the cylinder 24 and the retaining loop 18 are placed against the far side of the tree with the ends 20,22 of the loop 18 engaged with the seat 16. When the hunter either stands on the lower member 30 or occupies the seat 16, the weight of the hunter forces the traction wheel 44 against the tree with the retaining loop 18 pulled taut and in a diagonal disposition. Then as the hunter turns the crank handle 50, the apparatus 12 ascends the tree. As the ascent progresses, the safety blade 32 ratchets upwards along the tree and locks the entire apparatus 12 in a final elevated position. The safety blade 32 must be retracted in order to lower the apparatus 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved portable tree climbing apparatus for a hunter for ascending and descending a tree comprising, in combination:

an upper member having a seat adapted for supporting the hunter and an arcuate retaining loop adapted for rolling communication with the tree and keeping the upper member in a horizontal disposition when ascending and descending the tree, the retaining loop having a first end and a second end adapted for releasable engagement with the seat and further including a cylinder disposed in a middle section of the retaining loop for rotatable communication when ascending or descending the tree, the seat further being adapted with means to allow the hunter to face the tree or face away from the tree when the apparatus has reached the desired elevation;

a lower member having a safety blade engageable with a trunk of the tree for keeping the apparatus in stable communication with the trunk when ascending the tree, the lower member further being adapted with a plurality of retaining rods, the plurality of retaining rods further having an upper rod being pivotally coupled with an upper portion of the safety blade and a lower rod being positionable between a lower portion of the safety blade and the tree for maintaining the disengaged status of the safety blade when the hunter descends the tree;

a traction wheel disposed between the upper member and the lower member and having a plurality of teeth and being disposed on an upstanding elongated member, the teeth being in intermittent contact with the trunk for effortlessly ascending and descending the tree, the wheel further including a crank handle and a reduction gear box in tooth communication with traction wheel for reducing the effort required to ascend the tree; and a plurality of cross braces obliquely disposed and being in support communication with the lower member and the upper member for maintaining the relative distance between the two members.

2. A fast track tree climbing apparatus comprising an upper member having a seat adapted for supporting a hunter, a retaining loop having a first end and a second end adapted for releasable engagement with the seat, a lower member having a safety blade engageable with a trunk of the tree for keeping the apparatus in stable communication with the trunk when ascending the tree, a traction wheel disposed between the upper member and the lower member and having a plurality of teeth and being disposed on an upstanding elongated member, a plurality of cross braces obliquely disposed and being in support communication with the lower member and the upper member for maintaining the relative distance between the two members, wherein a plurality of retaining rods further includes an upper rod pivotally coupled with an upper portion of the safety blade and a lower rod in releasable engagement with a lower portion of the safety blade for maintaining the disengaged status of the safety blade when the hunter descends the tree.

* * * * *